US009254027B2

(12) United States Patent
Emery

(10) Patent No.: US 9,254,027 B2
(45) Date of Patent: Feb. 9, 2016

(54) SPECIAL INDIVIDUAL DEODORANT POWDER APPLICATOR AND PACKAGE

(71) Applicant: Cathy Jo Emery, Muncie, IN (US)

(72) Inventor: Cathy Jo Emery, Muncie, IN (US)

( * ) Notice: Subject to any disclaimer, the term of this patent is extended or adjusted under 35 U.S.C. 154(b) by 540 days.

(21) Appl. No.: 13/742,141

(22) Filed: Jan. 15, 2013

(65) Prior Publication Data

US 2013/0183077 A1 Jul. 18, 2013

Related U.S. Application Data

(60) Provisional application No. 61/587,169, filed on Jan. 17, 2012.

(51) Int. Cl.

| | |
|---|---|
| ***A45D 33/36*** | (2006.01) |
| ***A45D 33/00*** | (2006.01) |
| *A45D 40/00* | (2006.01) |

(52) U.S. Cl.

CPC ..... *A45D 33/00* (2013.01); *A45D 33/005* (2013.01); *A45D 33/36* (2013.01); *A45D 40/0087* (2013.01); *A45D 2200/1009* (2013.01)

(58) Field of Classification Search

CPC ..... A45D 33/005
USPC ..... 401/200, 6, 48
See application file for complete search history.

(56) References Cited

U.S. PATENT DOCUMENTS

| | | | | |
|---|---|---|---|---|
| 1,975,693 | A | 10/1934 | Killian | |
| 5,373,966 | A | 12/1994 | O'Reilly | |
| 5,569,230 | A * | 10/1996 | Fisher et al. | 604/385.06 |
| 6,406,206 | B1 | 6/2002 | Girardot et al. | |
| 6,492,307 | B1 | 12/2002 | Matsuo et al. | |
| 2008/0269710 | A1 * | 10/2008 | Caracci et al. | 604/385.06 |
| 2009/0300865 | A1 * | 12/2009 | Spain | 15/105 |

* cited by examiner

*Primary Examiner* — Mark A. Laurenzi, III
*Assistant Examiner* — Thomas M Abebe
(74) *Attorney, Agent, or Firm* — Ritchison Law Offices, PC; John D Ritchion

(57) ABSTRACT

A device that is a packaged, individual deodorant powder applicator comprised of an application sheet with a non-impervious surface and a perimeter, an external sealed sheet surface, with a perimeter, the surface being impervious to liquids, capable of containing powder, and able to act as packaging; a means for sealing, at the perimeters, the external sheet surface to the application sheet, such as an adhesive; a powder reservoir created between the interior of the application sheet and the external sheet and contained by the sealed perimeter; powder within the reservoir; a means for closing the device halves without tab, such as adhesive; and a means for holding device such as a handle/spine wherein the sheets are configured and sealed to hold the powder in the reservoir where the using person may hold the device and apply the powder to the selected user's surface.

1 Claim, 9 Drawing Sheets

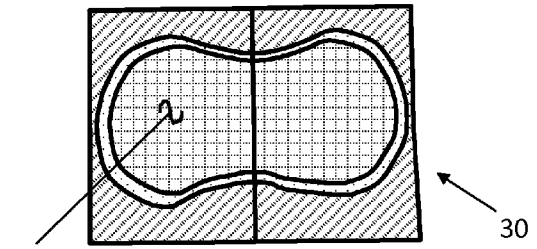
Fig. 1 A
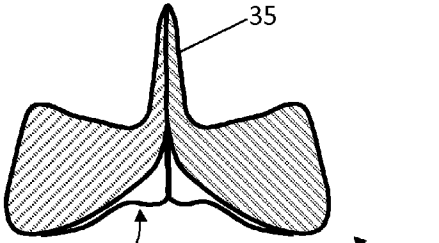
Fig. 1 B
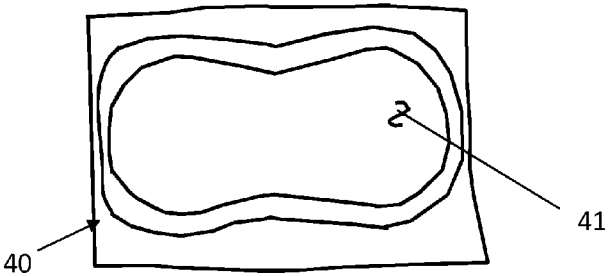
Fig. 1 C
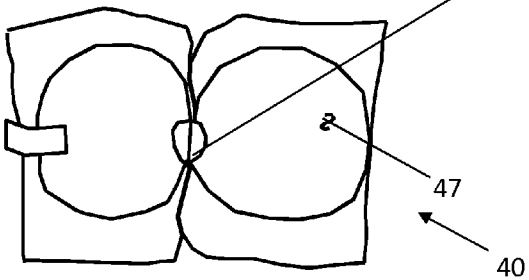
Fig. 1 D
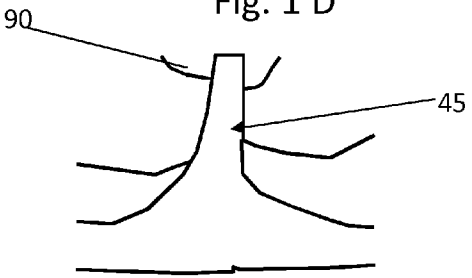
Fig. 1 E
Fig. 1

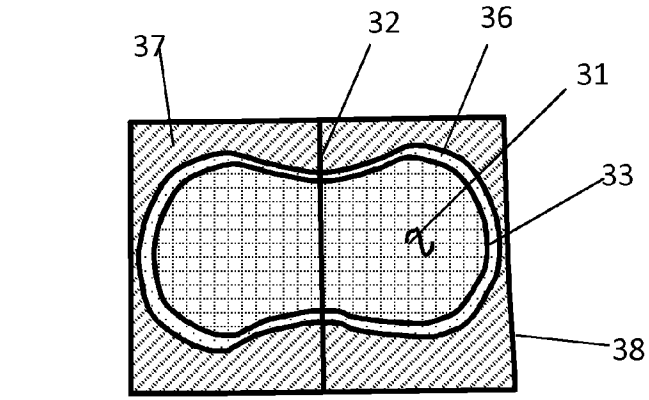
Fig. 2 A
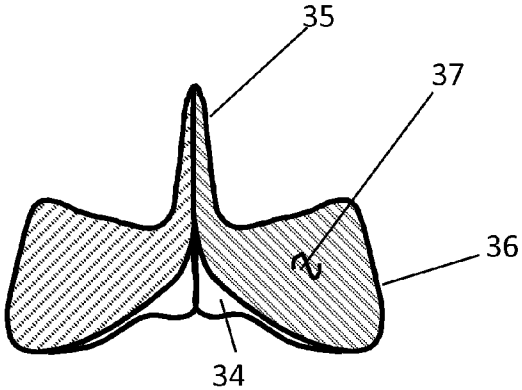
Fig. 2 B
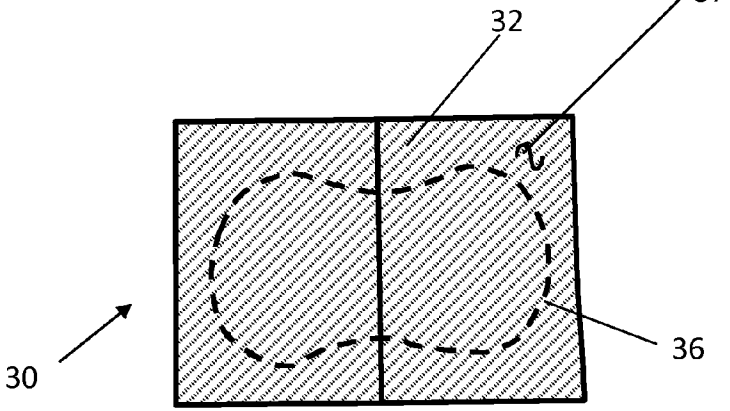
Fig. 2 C
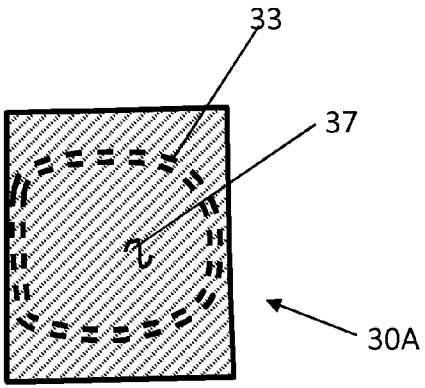
Fig. 2 D
Fig. 2

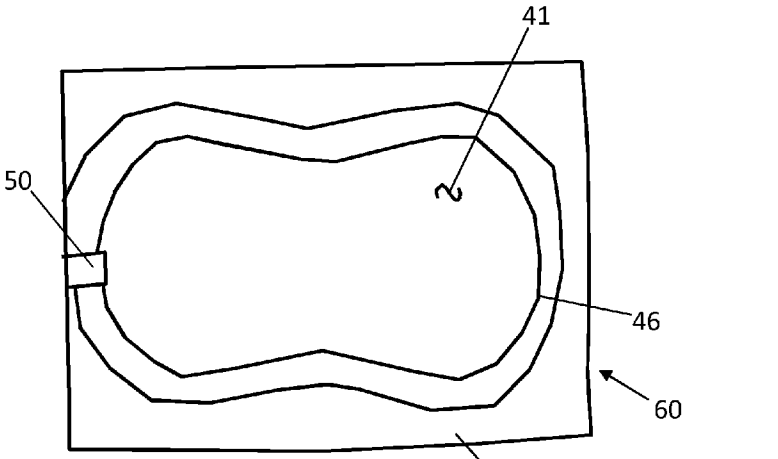
Fig. 6 A
Prototype 7
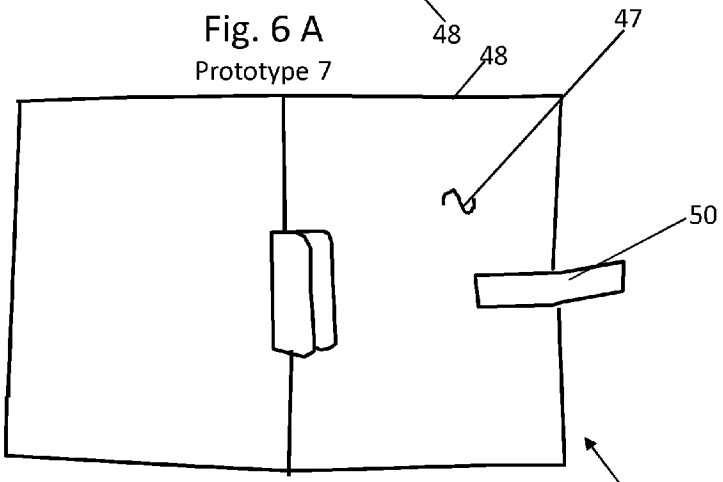
Fig. 6 B
Prototype 7
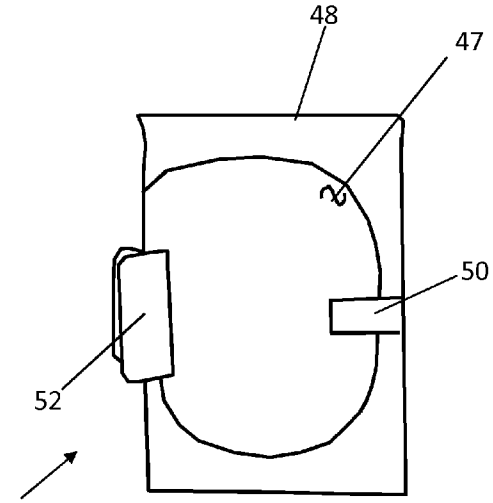
Fig. 6 C
Prototype 7
Fig. 6

Prototype 4

Prototype 4

Prototype 4

Prototype 5

Prototype 6

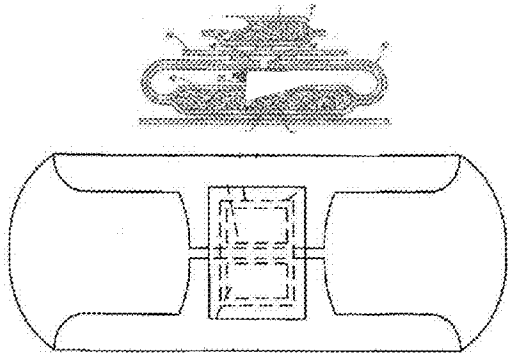
Fig. 9 A
Prior Art
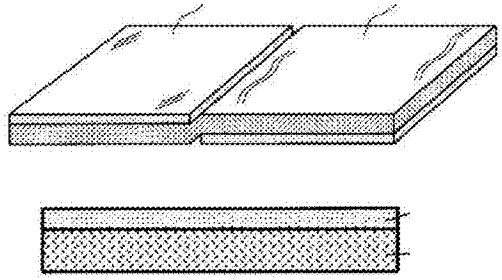
Fig. 9 B
Prior Art
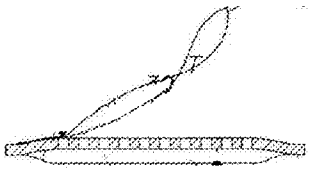
Fig. 9 C
Prior Art
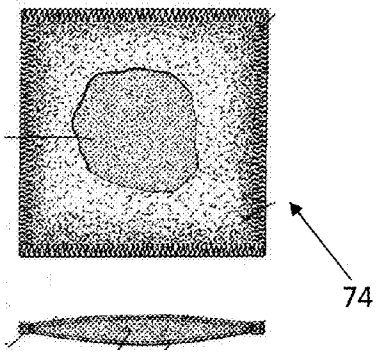
Fig. 9 D
Prior Art
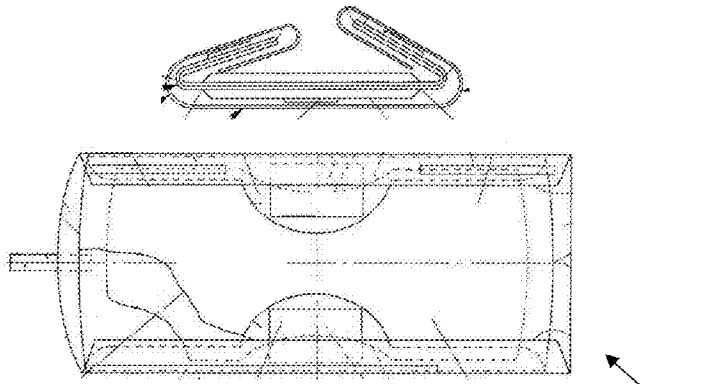
Fig. 9 E
Prior Art
Fig. 9

SPECIAL INDIVIDUAL DEODORANT POWDER APPLICATOR AND PACKAGE

CROSS-REFERENCE TO RELATED APPLICATIONS

This application claims the benefit of Provisional Patent Application Ser. No. 61/584,361 filed Jan. 17, 2012 by Cathy Jo Emery entitled "Special Individual Deodorant Powder Applicator and Package".

FIELD OF INVENTION

This invention relates generally to a hygiene article having a powdered substrate applicator. More particularly it relates to applicators for use in manually applying powder of a substance onto a desired target skin surface.

The new improved product presented here is a packet, or packet combination, containing a powdered substrate is provided. The packet, or packet combination, may be used as an individual portion applicator for a hygiene product such as a deodorant or anti-chafing powder. The applicator is used so that the powder may be used to provide a benefit such as moisture and/or odor control.

FEDERALLY SPONSORED RESEARCH

None.

SEQUENCE LISTING OR PROGRAM

None.

BACKGROUND

Field of Invention and Prior Art

1. Background and Problem Solved

In the field of personal hygiene and comfort, there are currently no known hygiene and powder applicator devices that are effective at providing the objects of this invention. With devices for hygiene, powder and sanitary products, if a person needs or desires the use and application of a powder, then they are required to use a cumbersome bottle of powder that they carry. Even if the bottle is a miniature size, they need to also carry some powder puff or applicator added to the cumbersome devices which they need to carry along in one's bag or accessory pack. This new and special individual deodorant powder applicator and package improves the situation and allows for a convenient and individually packaged device to be easily carried in a pocket or bag and ready for use—and then made ready for disposal. The Special individual deodorant powder applicator and package have several benefits over existing and prior art devices such as size, easy packaging, sanitary and able to manufacture easily on existing process equipment.

2. Prior Art

Prior art begins with a U.S. Pat. No. 1,975,693 issued to KILLIAN in 1934 called a Powder Puff. Here the device references a new and novel construction of powder puffs with the purpose to provide a character such that it shall contain a quantity of powder which shall be small, compact and simple in construction, sanitary, inasmuch as the same is discarded after the supply of powder is exhausted, one in which the powder sifts or permeates through only one side or face of the puff and in which the supply of powder is to be delivered by the force of slight taps upon the impervious face of the puff.

It fails to show a packaging or closure means as with the new individual deodorant powder applicator and package. Next there is the U.S. Pat. No. 5,373,966 issued to O'Reilly in 1994. This device is called a single use dispensing sachets and method of and means for manufacture of same. It demonstrates a single use dispensing sachet which is made up of flexible sheet sections peripherally sealed to define an outer envelope, and within the outer envelope is a sealed compartment containing the sachet contents. The compartment is ruptured to displace the contents into an expansion chamber within the sachet so as to retard the flow of the contents and prevent splashing. The device teaches and provides a liquid content and impervious to liquids, unlike the individual deodorant powder applicator and package taught herein.

A further device is shown by U.S. Pat. No. 5,569,230 issued to Fisher, et al. in 1996. This device is entitled an individually packaged sanitary napkin having cleaning wipe packaged therewith. Taught and demonstrated is an individually packaged sanitary napkin having a cleansing wipe packaged therewith. The individually packaged sanitary napkin includes a wrapper that covers the sanitary napkin's adhesive fastener prior to use. The sanitary napkin wrapper can be provided with a flap or pouch for securing the used sanitary napkin for disposal. This differs from the individual deodorant powder applicator and package lacks a powder application and dispensing configuration and teaches a separate and moist wipe included with the product/device. Next, U.S. Pat. No. 6,406,206 issued to Girardot, et al. in 2002 is called an applicator for applying and distributing substances to target surfaces. Here is taught an applicator for applying and distributing a substance onto a target surface. The applicator comprises a substantially planar sheet of compressible, conformable material having opposed first and second surfaces and an interior region between said first and second surfaces. The applicator further includes at least one discrete reservoir underneath the first surface which is at least partially filled with a substance and at least one discrete aperture formed in the first surface which is in fluid communication with the reservoir. In one embodiment, an applicator provides a removable cover sheet which aids in the containment of the substance. The device lacks the built-in packaging accomplished by the Emery device.

Another U.S. Pat. No. 6,492,307 issued to Matsuo, et al. in 2002 is called a personal cleansing sheet. This teaches a personal cleansing sheet with which the skin and hair can be easily cleansed of oily soils such as sebum and aqueous soils such as sweat or salts, has a structure in which an oily substance absorption layer that serves as a region that absorbs oil substances is laminated with an aqueous cleansing liquid retention layer that serves as a region that retains an aqueous cleansing liquid. It fails to describe a powder reservoir or packaging means. Finally, in US Patent Application publication 20080269710 provided by Caracci et al. in 2008 is shown a hygiene article having a wipe and powdered substrate combination. This application demonstrates a packet, or packet combination, containing a wipe and powdered substrate. The packet, or packet combination, may be used in conjunction with a hygiene article such as a sanitary napkin. The wipe is used to clean an area of skin or hair that has residual menstrual, urinary, or fecal material left behind after the removal of a hygiene article. The powder may then be used to provide an added benefit such as odor control. The addition of the extra and moist wipe is not included in the Emery device shown herein. The extra causes concerns being exposed to the powder, having more cost and being more difficult to package.

As far as known, there are no Special individual deodorant powder applicator and package devices known in prior art. It is believed that this product is unique in its design and technologies.

SUMMARY OF THE INVENTION

This invention is a Special individual deodorant powder applicator and package device. Taught here are the ways that an outer surface of a packet and an inner sheet—that may permit powder to flow through—creates an internal space, wherein the internal space is a discrete compartment. The internal space contains a powdered substrate disposed within the discrete compartment.

The preferred embodiment of the Special individual deodorant powder applicator and package device is comprised of (a) an application sheet with a non-impervious surface and a perimeter (the not impervious feature is a means to permit powder from reservoir to be applied to user's surface);

(b) an external sealed sheet surface, with a perimeter, the surface being impervious to liquids, capable of containing powder, and able to act as packaging;

(c) a means for sealing, at the perimeters, the external sheet surface to the application sheet (such means being an adhesive, heat seal, crimp and the like);

(d) a powder reservoir created between the interior of the application sheet and the external sheet and contained by the sealed perimeter;

(e) a powder within the reservoir;

(f) a means for closing the device halves without tab (such as adhesive, heat seal, crimp and the like); and (g) a means for holding device such as a Handle/Spine of preferred prototype)

Wherein the sheets are configured and sealed to hold the powder in the reservoir where the using person may hold the device and apply the powder to the selected user's surface.

The newly invented Special individual deodorant powder applicator and package device may be manufactured at low volumes by very simple means and in high volume production by more complex and controlled systems. It is anticipated that current processes and manufacturing equipment used to make other hygiene devices may be modified and adapted to produce this product.

Objects and Advantages

There are several objects and advantages of the Special individual deodorant powder applicator and package device. There are currently no known hygiene and powder applicator devices that are effective at providing the objects of this invention.

In the field hygiene, powder and sanitary products, if a person needs or desires the use and application of a powder, then they are required to use a cumbersome bottle of powder that they carry. Even if the bottle is a miniature size, they need to also carry some powder puff or applicator added to the cumbersome devices to transport along in one's bag or accessory pack. This special individual deodorant powder applicator and package improves the situation and allows for a convenient and individually packaged device easily carried in a pocket or bag and ready for use—and then disposal.

The Special individual deodorant powder applicator and package have several advantages and benefits. As an example and not as a limitation to the scope and spirit of this invention, some of these benefits are in the following Table.

| Item | Advantage |
|---|---|
| 1 | Specific size |
| 2 | Sanitary |
| 3 | Compact |
| 4 | Packaged easily |
| 5 | Can use existing processes for manufacturing |
| 6 | Many uses |

Finally, other advantages and additional features of the present Special individual deodorant powder applicator and package device will be more apparent from the accompanying drawings and from the full description of the device. For one skilled in the art of hygiene and powder application devices for individuals, it is readily understood that the features shown in the examples with this product are readily adapted to other types of hygiene and powder systems and devices.

DESCRIPTION OF THE DRAWINGS

Figures

The accompanying drawings, which are incorporated in and constitute a part of this specification, illustrate an embodiment of the Special individual deodorant powder applicator and package device that is preferred. The drawings together with the summary description given above and a detailed description given below serve to explain the principles of the Special individual deodorant powder applicator and package device for individual applications. It is understood, however, that the special individual deodorant powder applicator and package device is not limited to only the precise arrangements and instrumentalities shown.

FIGS. 1 A through 1 E are sketches of the special individual deodorant powder applicator drawings and prototype.

FIGS. 2 A through 2 D are design sketches of the preferred special individual deodorant powder applicator and package device with components and features noted.

FIGS. 6 A through 6 C are an alternative prototype with components and features shown.

FIGS. 9 A through 9 E are sketches of prior art devices for reference purposes.

DESCRIPTION OF THE DRAWINGS

Reference Numerals

Figure 3:
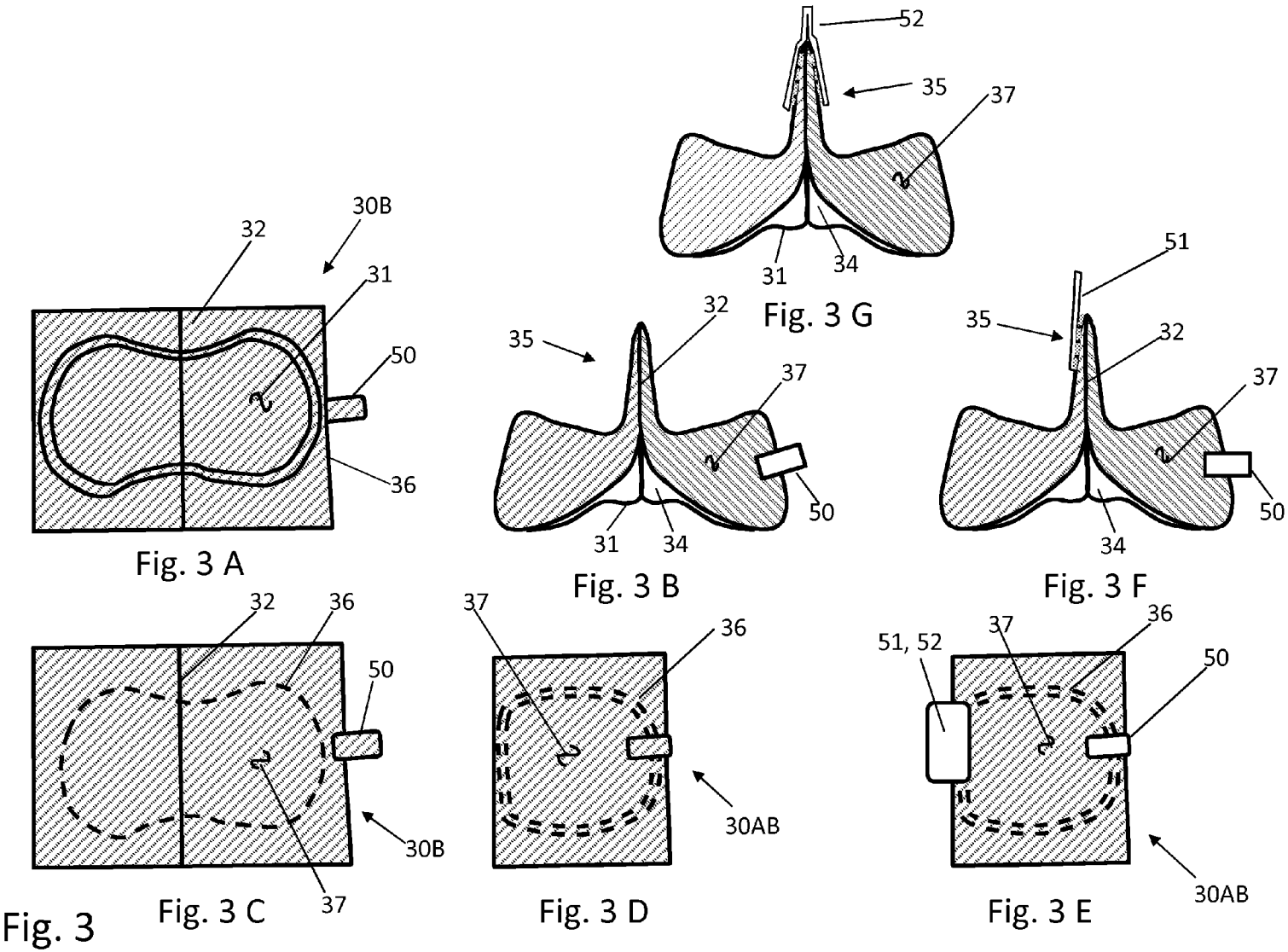
FIGS. 3 A through 3 G are sketches of alternative special devices with the components and features shown.

The following list refers to the drawings:

TABLE A

Reference numbers

| Ref # | Description |
|---|---|
| 30 | Special individual deodorant powder applicator and package |
| 30A | Folded preferred device |
| 30B | Special device with closure tab |
| 30AB | Folded half of device with closure tab |
| 31 | Application sheet with non-impervious surface of special deodorant device - the not impervious feature is a means to permit powder from reservoir to be applied to user's surface. The application sheet is non-irritating to one's skin. |
| 31A | Aperture or means to permit powder to flow and be dispersed to user's surface and to be applied |
| 32 | Application division line of two halves of device |
| 33 | Perimeter of reservoir cover surface 31 |
| 34 | Powder reservoir |
| 35 | Handle/Spine of preferred device |
| 36 | Perimeter of powder reservoir |
| 37 | External sealed sheet surface of device impervious to liquids, capable of containing powder, somewhat soft and non-irritating and able to act as packaging |
| 37A | Separate sealable package for the device 31 |
| 37B | Means to seal (such as adhesive, heat seal, crimp and the like) separate package 37A |
| 38 | Perimeter of external surface |
| 39 | Means for sealing external sheet surface 37 to application sheet 31 (such means being an adhesive, heat seal, crimp and the like) |
| 40 | Prototype 8 of preferred special deodorant powder individual applicator and integral package |
| 41 | Applicator dispensing surface of prototype |
| 42 | Impervious flap sheet removably attached over the non-impervious application sheet 31, the flap to better contain the powder 49 in the powder reservoir 34 |
| 44 | Means for attaching the flap sheet 42 to the applicator sheet 31, the means being such as adhesive, heat seal, crimp and the like |
| 45 | Means for holding device such as a Handle/Spine of preferred prototype) the preferred handle 45 is composed of three sections 45L, 45C and 45 R [left, center and right] which are separated by a perforation line and permit the three sections to come together to form a handle while forcing the applicator side 31 to become somewhat convex - i.e. push out from the handle side. |
| 45A | Stiff spine |
| 45B | Soft tab spine |
| 46 | Perimeter of powder reservoir |
| 47 | External sealed surface |
| 48 | Package perimeter |
| 49 | Powder |
| 50 | Closure tab for packaging device |
| 50A | Means for closing the device halves without tab (such as adhesive, heat seal, crimp and the like) |
| 51 | Single leaf handle tab for spine |
| 52 | Split leaf handle tab for spine |
| 55 | Means for attaching - Adhesive, Heat Weld, etc. |
| 60 | Alternative prototype 7 with tab |
| 61 | Alternative Prototype 4 - No package, Stiff Spine |
| 62 | Alternative Prototype 5 - No Package, Soft Tab Spine |
| 63 | Alternative Prototype 6 - No Package, Contour Perimeter |
| 65 | Alternative Prototype 1 - Package and No Contour |
| 66 | Alternative Prototype 2 - Contour, 1 Piece and No Spine |
| 67 | Alternative Prototype 3 - Contour, 1 Piece, and No Package |
| 71 | Prior art US Patent Application Publication 2008/0269710 |
| 72 | Prior Art U.S. Pat. No. 6,492,307 |
| 73 | Prior Art U.S. Pat. No. 6,406,206 |
| 74 | Prior Art U.S. Pat. No. 1,975,693 |
| 75 | Prior Art U.S. Pat. No. 5,569,230 |
| 90 | User of preferred prototype |

DETAILED DESCRIPTION OF PREFERRED EMBODIMENT

The present developed invention is a Special individual deodorant powder applicator and package device. This invention relates generally to a hygiene article having a powdered substrate applicator. More particularly it relates to applicators for use in manually applying powder of a substance onto a desired target skin surface.

The new improved product presented here is a packet, or packet combination, containing a powdered substrate is provided. The packet, or packet combination, may be used as an individual portion applicator for a hygiene product such as a deodorant or anti-chafing powder. The applicator is used so that the powder may be used to provide a benefit such as moisture and/or odor control.

Taught here are the ways that an outer surface of a packet and an inner sheet—that may permit powder to flow through—creates an internal space, wherein the internal space is a discrete compartment. The internal space contains a powdered substrate disposed within the discrete compartment.

The advantages for the Special individual deodorant powder applicator and package device 30 are listed above in the introduction. Succinctly the benefits are that the device:

Can be a specific size;
Is sanitary;
Is compact;
Can be packaged easily;
Can use existing processes for manufacturing; and
Has many uses The preferred embodiment of the Special individual deodorant powder applicator and package device is comprised of:

(a) an application sheet with a non-impervious surface and a perimeter (the not impervious feature is a means to permit powder from reservoir to be applied to user's surface);
(b) an external sealed sheet surface, with a perimeter, the surface being impervious to liquids, capable of containing powder, and able to act as packaging;
(c) a means for sealing, at the perimeters, the external sheet surface to the application sheet (such means being an adhesive, heat seal, crimp and the like);
(d) a powder reservoir created between the interior of the application sheet and the external sheet and contained by the sealed perimeter;
(e) a powder within the reservoir;
(f) a means for closing the device halves without tab (such as adhesive, heat seal, crimp and the like); and
(g) a means for holding device such as a Handle/Spine of preferred prototype)

Wherein the sheets are configured and sealed to hold the powder in the reservoir where the using person may hold the device and apply the powder to the selected user's surface.

There is shown in FIGS. 1-9 a complete description and operative embodiment of the Special individual deodorant powder applicator and package device. In the drawings and illustrations, one notes well that the FIGS. 1-9 demonstrate the general configuration and use of this product and prototypes. The various example uses are in the operation and use section, below.

The accompanying drawings, which are incorporated in and constitute a part of this specification, illustrate an embodiment of the Special individual deodorant powder applicator and package device 30 that is preferred. The drawings together with the summary description given above and a detailed description given below serve to explain the principles of the Special individual deodorant powder applicator and package device 30. It is understood, however, that the Special individual deodorant powder applicator and package device 30 is not limited to only the precise arrangements and instrumentalities shown. Other examples of hygiene and powder application devices and uses are still understood by one skilled in the art of hygiene and powder application devices to be within the scope and spirit shown here.

FIGS. 1 A through 1 E are sketches of the special individual deodorant powder applicator device 30 drawings and prototype. FIG. 1 A shows a drawing of the device 30 from a top, inside view showing the Application sheet 31 with non-impervious surface of special deodorant device—the not impervious feature is a means to permit powder 49 from reservoir 34 to be applied to user's 90 surface. The application sheet is non-irritating to one's skin. FIG. 1 B shows a general side view of the device 30 with the handle or spine 35 demonstrated. FIG. 1 C shows the prototype 40 of prototype sample #8 with the applicator dispensing surface 41 of prototype 40. FIG. 1 D is another view of the preferred prototype sample #8 40 showing the handle/spline 45 and the exterior surface 47. FIG. 1 E shows another view of the prototype sample #8 40 with the handle 45 shown grasped and ready for use by the user 90.

FIGS. 2 A through 2 D are design sketches of the preferred special individual deodorant powder applicator and package device 30 with components and features noted. FIG. 2 A shows a drawing of the device 30 from a top, inside view showing the Application sheet 31 with non-impervious surface of special deodorant device—the not impervious feature is a means to permit powder 49 from reservoir 34 to be applied to user's 90 surface. The application sheet is non-irritating to one's skin. Also depicted is the application division line 32 for splitting the device 30 into two (2) halves to permit the handle 35 to be formed. Shown here is the External sealed sheet surface 37 of device 30 impervious to liquids, soft and non-irritating capable of containing powder, and able to act as packaging. The perimeter 36 between the applicator sheet 31 and the external sheet 37 is depicted. Here at this perimeter 36 is where the two sheets 31, 37 are joined. The means 39 (not viewed here) for sealing external sheet surface 37 to application sheet 31 (such means being an adhesive, heat seal, crimp and the like).

Next, in FIG. 2 B shows a general side view of the device 30 with the handle or spine 35 demonstrated. The external sheet surface 37 is also shown. FIG. 2 C is a general TOP view of the applicator device 30 with the top sheet surface 37 and the perimeter 36 denoted. FIG. 2 D shows the half/folded applicator device 30A with the top sheet surface 37 and the perimeter of the reservoir 33.

FIGS. 3 A through 3 G are sketches of alternative special features for applicator device 30 with the components and the special features shown. FIG. 3 A shows an alternative device 30B with a closure tab 50. The division line 32 is also show. FIG. 3 B shows a side view of the device 30B with a tab 50, with the spine/handle 35, with the applicator sheet 31 and with the reservoir 34. FIG. 3 C shows a top view of the device 30B with a tab 50, with the external sheet surface 37, with the division split 32, and with the perimeter outline 36 denoted. FIG. 3 D shows a top view of the half device 30AB with a tab 50, with the external sheet surface 37, and with the perimeter 36 all shown. FIG. 3 E shows a top view of the half device 30AB with a tab 50, with the external sheet surface 37, with a single leaf 51 or split leaf 52 handle tab, and with the perimeter 36 all shown. FIG. 3 F shows a side view of the device 30AB with a tab 50, with the spine/handle 35, with the applicator sheet 31, with the single leaf spine/handle 51, and with the reservoir 34. FIG. 3 G shows a side view of the device 30AB with a tab 50, with the spine/handle 35, with the applicator sheet 31, with the split leaf spine/handle 52, and with the reservoir 34.

Figure 4:
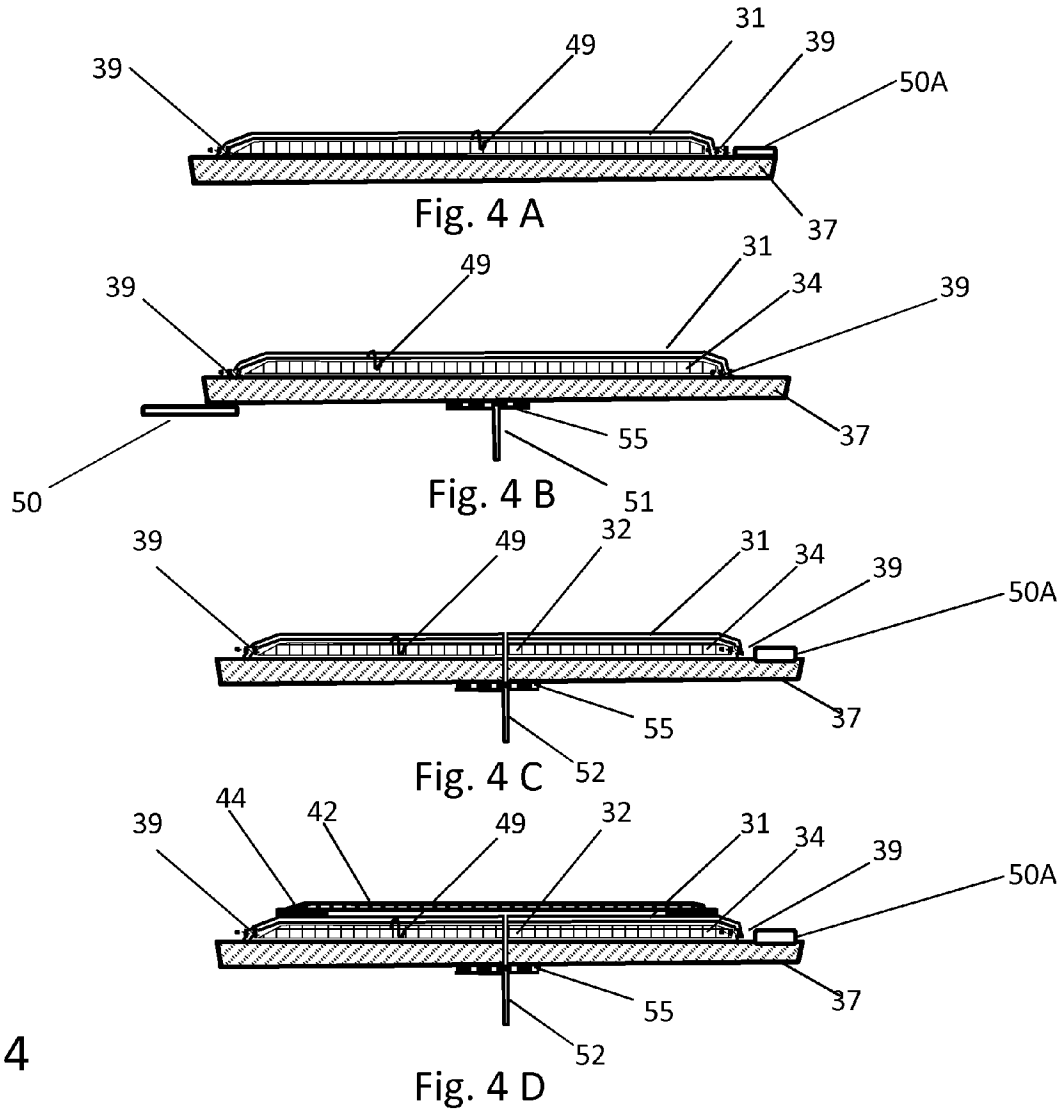
FIGS. 4 A through 4 D are sketches of sections of the special devices with the components and features shown from generally a side section view.

FIGS. 4 A through 4 C are sketches of section views of the special applicator device 30 with the components and features shown from generally a side section view. FIG. 4 A shows the exterior sheet surface 37, the applicator side 31, the means 39 to secure the sheets 31, 37 and the powder 39. FIG. 4 B shows the exterior sheet surface 37, the applicator side 31, the means 39 to secure the sheets 31, 37, the closure tab 50, the single leaf handle 51, the means 55 to secure the handle 55 to the exterior sheet 37, and the powder 39. FIG. 4 C shows the exterior sheet surface 37, the applicator side 31, the means 39 to secure the sheets 31, 37, the closure means (not tab) 50A, the split leaf handle 52, the means 55 to secure the handle 55 to the exterior sheet 37, and the powder 39. FIG. 4 D shows the exterior sheet surface 37, the applicator side 31, the means 39 to secure the sheets 31, 37, the closure means (not tab) 50A, the split leaf handle 52, the means 55 to secure the handle 55 to the exterior sheet 37, and the powder 39. The added, discrete component here is a removable, thin impervious flap sheet 42. The impervious flap sheet 42 is removably attached over the non-impervious application sheet 31, the flap to better contain the powder 49 in the powder reservoir 34. The means for attaching the sheet 42 to the application sheet 31 is a means for attaching 44 such as adhesive, heat seal, crimp and the like.

Figure 5:
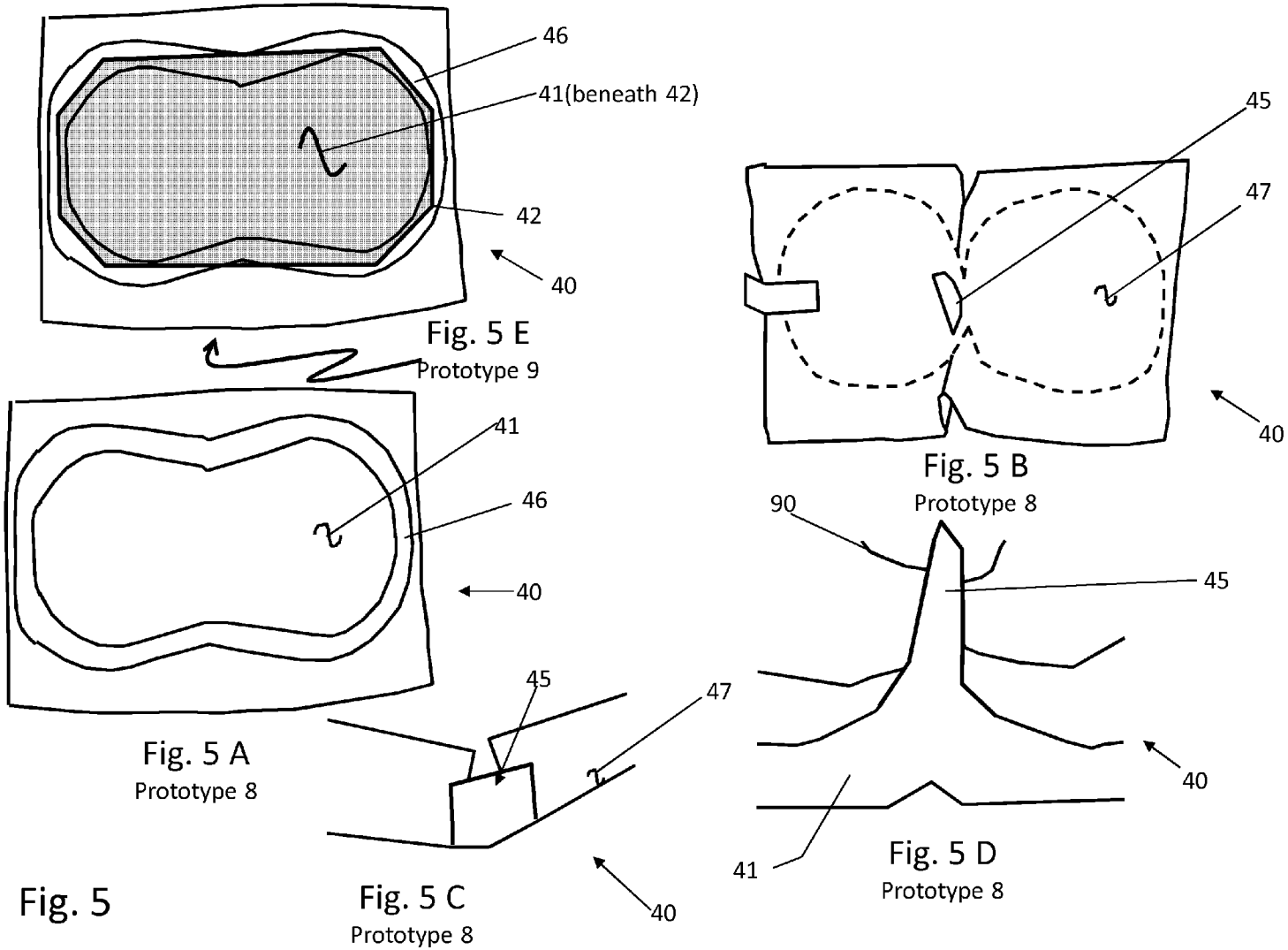
FIGS. 5 A through 5 E are the preferred prototype sample with the components and features shown.

FIGS. 5 A through 5 E show the preferred prototype sample #8—40 with the components and features shown. Here in FIG. 5 A is shown the reservoir perimeter 46 and the applicator surface 41. FIG. 5 B shows a top view of the preferred prototype 40 with the exterior surface sheet 47 and the handle/spine 45 for the prototype 40. FIG. 5 C shows an isometric view of the preferred prototype 40 with the exterior surface sheet 47 and the handle/spine 45 for the prototype 40. FIG. 5 D shows another view of an alternative prototype sample #8 40 with the handle 45 shown grasped and ready for use by the user 90. Note in FIGS. 5 B through 5 C are shown the handle sections 45 where the preferred means for holding device 45 such as a Handle/Spine of preferred prototype) is composed of three sections 45L, 45C and 45 R [left, center and right] which are separated by a perforation line and permit the three sections to come together to form a handle while forcing the applicator side 31 to become somewhat convex—i.e. push out from the handle side. In FIG. 5 E is shown prototype sample #9 with the reservoir perimeter 46 and the applicator surface 41. Also note the impervious flap sheet 42 that is removably attached over the non-impervious application sheet 41.

FIGS. 6 A through 6 C are an alternative prototype devices with components and features shown. FIG. 6 A shows the prototype sample #7 60 with the applicator sheet surface 41, a closure tab 50 and the perimeter 46 of the powder reservoir. FIG. 6 B shows the prototype sample #7 60 from a top view with the exterior sheet surface 47, a closure tab 50, the split leaf handle 52, and the perimeter 48 of the exterior sheet. FIG. 6 C shows the folded prototype sample #7 60 with the exterior sheet surface 41, a closure tab 50, the split leaf handle 52, and the perimeter 48 of the exterior sheet 47.

Figures 7, 7A, 7B, 7C, 7D, 7E:
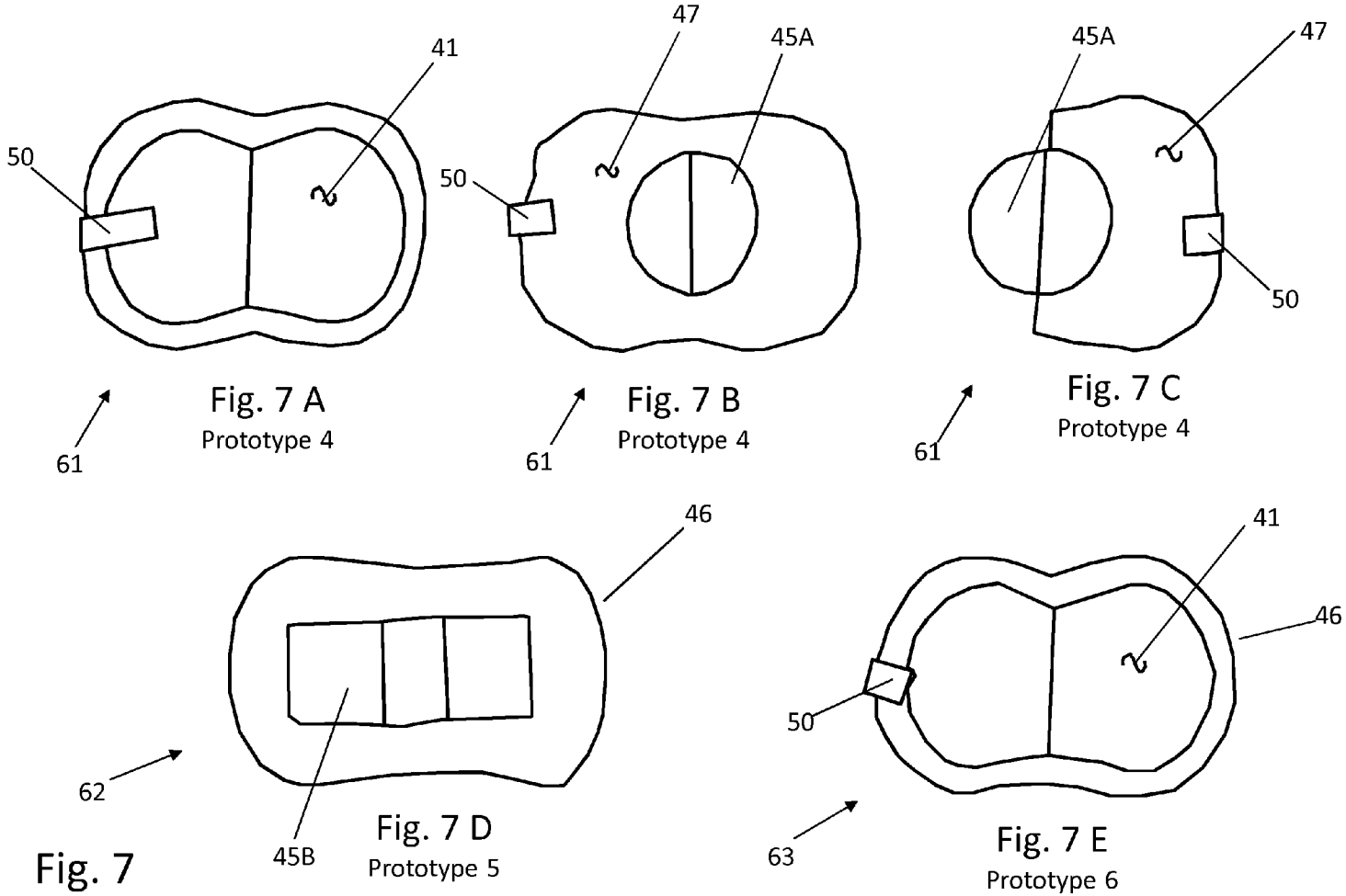
FIGS. 7 A through 7 E are additional alternative prototypes with the components and features shown.

FIGS. 7 A through 7 E are additional alternative prototype samples 61, 62, 63 with the components and features shown.

FIG. 7 A shows the prototype sample #4 61 with the applicator sheet surface 41 and a closure tab 50. FIG. 7 B shows the prototype sample #4 61 from a top view with the exterior sheet surface 47, a closure tab 50 and the stiff handle/spine 45A. FIG. 7 C shows the folded prototype sample #4 61 with the exterior sheet surface 47, a closure tab 50, the stiff handle 45A, and the package perimeter 48 of the exterior sheet 47. FIG. 7 D shows the prototype sample #5 62 from a top view with the exterior sheet surface 47, the reservoir perimeter 46, the package perimeter 48 and the soft handle/spine 45B. FIG. 7 E shows the prototype sample #6 63 with the applicator sheet surface 41, the perimeter 46 of the reservoir, and a closure tab 50.

Figure 8:
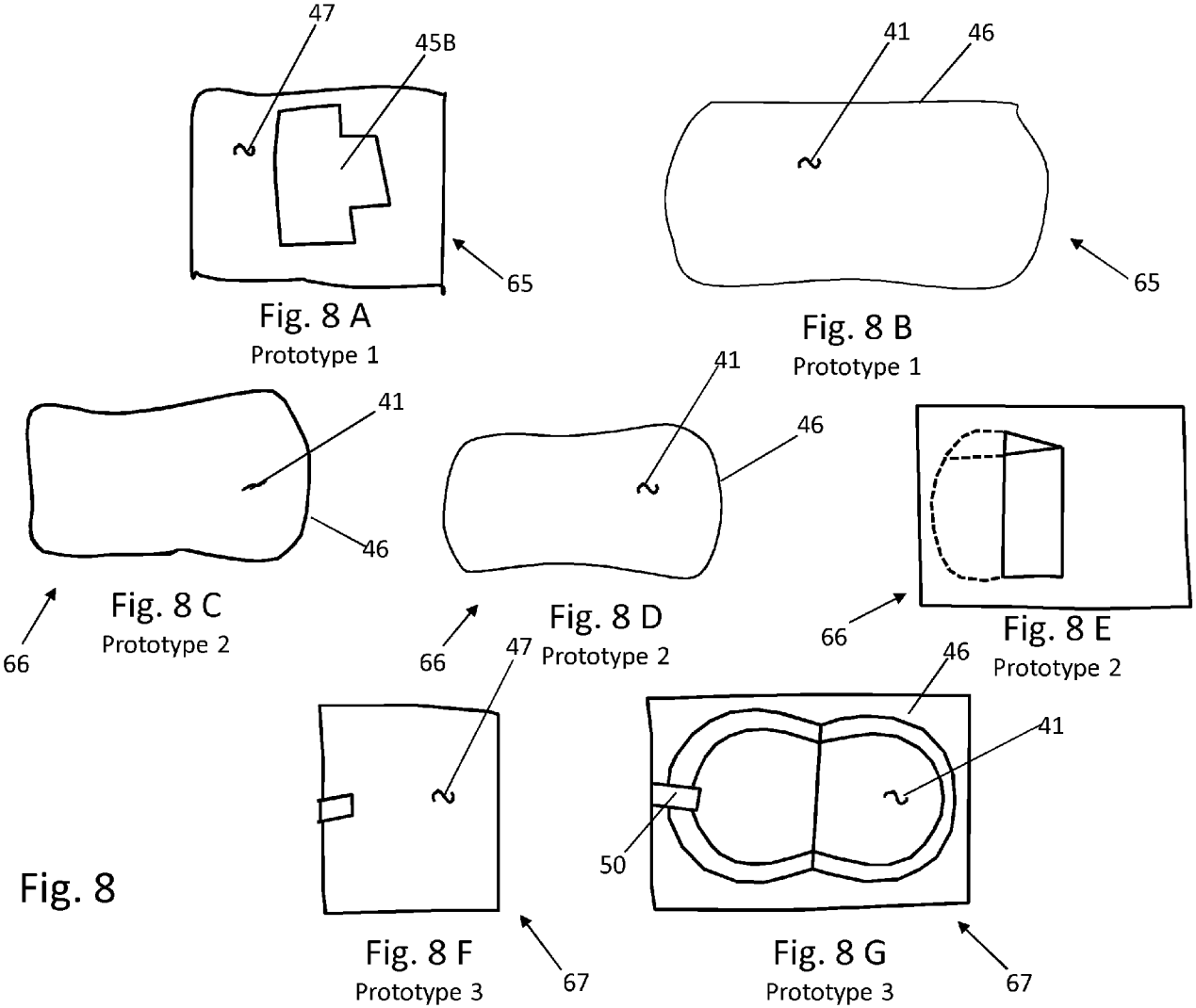
FIGS. 8 A through 8 G are more alternative prototypes with the components and features shown.

FIGS. 8 A through 8 G are more alternative prototypes 65, 66, 67 with the components and features shown. FIG. 8 A shows the prototype sample #1 65 with the exterior sheet surface 47 and a soft handle spine 45B. The separate package 37A, made of material similar to external sheet 37, is denoted with means to seal 37B. FIG. 8 B shows the prototype sample #1 65 with the applicator sheet surface 41 and a reservoir perimeter 46. FIGS. 8 C and 8 D show the prototype sample #2 66 with the applicator sheet surface 41 and a closure tab 50. FIG. 8 E shows the folded prototype sample #2 66. FIG. 8 F shows the folded prototype sample #3 67 with the exterior sheet surface 47 and a closure tab 50. FIG. 8 G shows the prototype sample #3 67 with the applicator sheet surface 41, the reservoir perimeter 46, and a closure tab 50.

FIGS. 9 A through 9 E are sketches of prior art devices for reference purposes. Here is shown in FIG. 9 A, prior art US Patent Application Publication 2008/0269710 71, in FIG. 9 B, prior art U.S. Pat. No. 6,492,307 72, in FIG. 9 C prior art U.S. Pat. No. 6,406,206 73, in FIG. 9 D prior Art U.S. Pat. No. 1,975,693 74, and in FIG. 9 E, prior Art U.S. Pat. No. 5,569, 230 75.

The outer surface 37 as packaging material of the device 30 defines an outer surface of the packet and an internal space, wherein the internal space or reservoir 34 is a discrete compartment. The packet contains at least one powdered substrate 49 disposed within the discrete compartment 34.

DEFINITIONS

The term "joined", as used herein, encompasses configurations in which a first element is directly secured to a second element. Joined also includes configurations in which the first element is indirectly secured to the second element by securing the first element to at least one intermediate member, which in turn is secured to the second element.

Additionally, the term joined covers configurations in which the first element is integral with the second element, such that the first element is part of the second element. The first element and the second element can be fixedly joined, or releasably joined.

As used herein, the term "fixedly joined" refers to a configuration as defined under the term "joined", where a first element cannot be separated from a second element without at least partially destroying one of the joined elements. As used herein, the term "releasably joined" also refers to a configuration as defined under the term "joined", where a first element may be separated from a second element without causing destruction or undue distortion to either element.

As used herein the term "individual packet", or "packet", refers to a structure comprising one or more packaging materials. The packaging materials form one or more discrete compartments. Further, a packet may be separate from other packets, or joined to other packets.

In any of the embodiments, a packet may be any desired shape. For example, the packet may be a square, rectangle, oval, circle, or any other desired shape in plan view. The packet can include a means for opening the packet in order to access a powdered substrate contained therein. For example, the packet can have a scored or die cut line of weakness to allow the packet to be opened easily with a tab, easy peel label, or any other opening mechanism; a "Dry-edge" sticker mechanism, such as a sticker with a dry edge for grasping; releasable adhesives; releasable heat and/or pressure seals; perforations; rupture seals; tear seals; or the packet can be made of a relatively easy to tear material such as, an easy to tear film.

The powder applicator may comprise a woven or non-woven web of natural fibers, synthetic fibers, or mixtures of natural and synthetic fibers. Natural fibers may include cellulosic fibers, such as wood pulp fibers, cotton, and rayon. Synthetic fibers may include fibers such as, polyolefin, for example polyester and polypropylene fibers. In certain other embodiments, the powder applicator can comprise a paper material, for example, paper material that is made of a wet-laid material in a manner used to produce toilet tissue or facial tissue. In certain embodiments, the wipe can comprise silk and/or foam, such as foam disclosed The powder applicator 30 can be any size or shape that may be used for applying powder to the skin, or providing other benefits. For example, in certain embodiments, the powder applicator may be rectangular or circular. In certain embodiments, the wipe may be about approximately 2 square inches in size to about 9 square inches in size.

The powder applicator sheet 31, may be textured, patterned embossed, dyed, printed with ink, clear polymer or colored polymer; or combinations thereof. For example, the powder applicator may be printed or dyed to give a visual signal of an active ingredient. The powder applicator may be patterned by hydroforming or any other method known in the art.

The powdered substrate, may be any unitary substrate which releasably comprises a powder suitable for application to the skin. In certain embodiments, for example the powdered substrate may be a fibrous sheet, film, foam, sponge, netting, puff or structure such as a brush, which has a powder applied thereon and/or therein. In certain embodiments a fibrous sheet may comprise a nonwoven material, wherein the non-woven material may be comprised of synthetic fibers and/or natural fibers. The powdered substrate may be a pocket formed from one or more materials, with powder contained in the space there between, wherein at least one of the materials is permeable to the powder. The powdered substrate may be a bag like structure containing powder. Further, the powdered substrate may be a powder dispensing brush.

In certain embodiments, a unit dose of about 0.01 grams to about 8 grams of powder is applied to the skin from the powdered substrate.

The powdered substrate 34 may also comprise a handle 45 of non-woven fibers, woven fibers, yarn, ribbon, or film material to make the powdered substrate easier to hold. The powder may be applied to the powdered substrate by spraying, dusting, coating, shaking, or any other manner known to one of ordinary skill in the art. The powder 49 may be held on the substrate by static force, pore size of material or structure forming the powdered substrate, adhesive, or combinations thereof.

As used herein, the term "powder" 49 is defined as a substance comprised of ground, pulverized, or otherwise finely dispersed solid particles. In certain embodiments, the powder may have a particle size in the longest dimension of from about 1 micron to about 100 microns. In certain other embodiments, the powder may have a particle size in the longest dimension from about 5 microns to about 40 microns. The particle shape of the powder may be spherical, ellipsoidal, or irregular. The powder may contain moisture absorbers, a carrier, skin feel components, odor control agents, anti-microbial agents, antiperspirants, skin protectants, emollients, skin moisturizers, anti-oxidants, binders to help the adhesion to skin, flow aids or anti-caking aids, botanicals, colorants, fragrances, or preservatives. The powder may be white, colored, or contain colored particles to give a visual signal of the active ingredients. Examples of powders include body powders, facial powders, talcum powders, clay powders, and cornstarch powders.

As used herein the term "user" 90 refers to a person who uses a wipe and/or powdered substrate on either themselves or another. For example, a user 90 could be the person using a powdered substrate to clean an infant who would be considered the wearer of a hygiene article, in this case a diaper.

The external sheet surface 37 or back sheet may be any flexible, liquid resistant, and in certain embodiments, liquid impervious material, for example, a polyolefinic film, such as a polyethylene film, as long as the material is as anticipated, somewhat soft and non-irritating.

The powder application surface 31 top sheet may be perforated or gauze like with apertures 31A and able to contain the powder 49 within the package, then release the powder as the applicator is placed contiguous to the user's 90 skin surface.

The applicator/top sheet 31 and the external/back sheet 37 may be joined along their peripheries 33, 38 using known techniques 39, either entirely so that the entire perimeter is circumscribed by such joinder, or are partially peripherally joined at the perimeter of the device. The releasable wrapper has a perimeter defined by longitudinal edges and lateral edges.

The configuration of the device may be manufactured by forming the plurality of apertures and reservoirs via thermal embossing with a heated die to the desired depth, then either injecting the substance into the reservoirs or flooding the substance into/onto the applicator and doctoring off the excess substance. A label or seal is then applied over the delivery zone and secured by thermal or adhesive means. The applicator may then be die cut to the final shape, or alternatively the die cutting step may be accomplished at the same time as the formation of the reservoirs, or any other suitable arrangement of steps. The substance may be heated or otherwise made flowable for such a process if necessary.

It will be understood that the embodiment(s) described herein is/are merely exemplary, and that one skilled in the art may make variations and modifications without departing from the spirit and scope of the invention. All such variations and modifications are intended to be included within the scope of the invention as described hereinabove. Further, all embodiments disclosed are not necessarily in the alternative, as various embodiments of the invention may be combined to provide the desired result.

OPERATION OF THE PREFERRED EMBODIMENT

The Special individual deodorant powder applicator and package device 30 has been described in the above embodiment. The manner of how the device operates is described below. One notes well that the description above and the operation described here must be taken together to fully illustrate the concept of the Special individual deodorant powder applicator and package device 30.

The preferred embodiment of the Special individual deodorant powder applicator and package device is comprised of (a) an application sheet with a non-impervious surface and a perimeter (the not impervious feature is a means to permit powder from reservoir to be applied to user's surface);
(b) an external sealed sheet surface, with a perimeter, the surface being impervious to liquids, capable of containing powder, and able to act as packaging;
(c) a means for sealing, at the perimeters, the external sheet surface to the application sheet (such means being an adhesive, heat seal, crimp and the like);
(d) a powder reservoir created between the interior of the application sheet and the external sheet and contained by the sealed perimeter;
(e) powder within the reservoir;
(f) a means for closing the device halves without tab (such as adhesive, heat seal, crimp and the like); and
(g) a means for holding device such as a Handle/Spine of preferred prototype)

Wherein the sheets are configured and sealed to hold the powder in the reservoir where the using person may hold the device and apply the powder to the selected user's surface.

Many products and uses are anticipated for the special individual deodorant powder applicator and package device 30. Such products include those in the skin care, cosmetics, pharmaceutical, and other personal care arenas. Some examples, and not limitations, are shown in the following Table.

| ITEM | USE/APPLICATION |
|---|---|
| 1 | Hygiene for women - individual deodorant/moisture refresher pad |
| 2 | Foot powder application pad |
| 3 | Medicine individual application pad |
| 4 | Military field pack deodorant powder applicator |
| 5 | Insect repellant applicator |
| 6 | Moisture/anti-chafing applicator for men and women |
| 7 | Athletes and medicinal or anti-chafing powder applicator |
| 8 | Infant/baby powder applicator |

The Special individual deodorant powder applicator and package device 30 is use to apply the powder 49 for the user 90 in one of the various applications shown above. The user 90 opens the device 30 by disengaging the tab 50 or tab means 50A. Then the user 90 grasps the device 30 by the handle/spline 35, 51, 52. Next the user 90 applies the powder 49. Finally the device 31 is disposed of after the application is complete. FIG. 1 E shows another view of the prototype sample #8 40 with the handle 45 shown grasped and ready for use by the user 90. FIG. 5 D shows another view of an alternative prototype sample #8 40 with the handle 45 shown grasped and ready for use by the user 90.

With this description it is to be understood that the Special individual deodorant powder applicator and package device 30 is not to be limited to only the disclosed embodiment of product. The features of the Special individual deodorant powder applicator and package device 30 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

What is claimed is:

1. A Special individual deodorant powder applicator and package device comprised of:

(a) an application sheet with a perimeter and a non-impervious material surface;

(b) an external sealed sheet surface, with a perimeter, the external surface being a material impervious to liquids, capable of containing powder, and able to act as packaging;

(c) a means for sealing, at the perimeters, the external sheet surface to the application sheet;

(d) a powder reservoir created between the interior of the application sheet and the external sheet and contained by the sealed perimeter;

(e) a powder with a specific use held within the reservoir;

(f) a means for closing the device halves without tab; and (g) a Handle/Spine composed of three sections which are separated by a perforation line and which permit the three sections to come together to form a handle while forcing the applicator side to become somewhat convex wherein the sheets are configured and sealed to hold the powder in the reservoir where the using person may hold the device and apply the powder to the selected user's surface and the not impervious surface is a way for permitting the powder from the reservoir to be applied to the surface of the user.

* * * * *